US009164412B2

(12) United States Patent
Horemans et al.

(10) Patent No.: US 9,164,412 B2
(45) Date of Patent: Oct. 20, 2015

(54) DIGITAL PRINTING SYSTEM WITH IMPROVED TONER REMOVAL

(71) Applicant: Xeikon IP BV, GZ Eede (NL)

(72) Inventors: Nick Horemans, Noorderwijk (BE); William Constant Waterschoot, Belsele (BE); Wim Libaers, Boortmeerbeek (BE); Lode Erik Dries Deprez, Wachtebeke (BE); Jürgen Norbert Bart Devlieghere, Borgerhout (BE)

(73) Assignee: Xeikon IP BV (NL)

( * ) Notice: Subject to any disclaimer, the term of this patent is extended or adjusted under 35 U.S.C. 154(b) by 0 days.

(21) Appl. No.: 14/244,302

(22) Filed: Apr. 3, 2014

(65) Prior Publication Data

US 2014/0301755 A1 Oct. 9, 2014

(30) Foreign Application Priority Data

Apr. 5, 2013 (NL) ..... 2010573

(51) Int. Cl.
*G03G 15/11* (2006.01)
*G03G 15/02* (2006.01)

(52) U.S. Cl.
CPC ..... *G03G 15/0266* (2013.01); *G03G 15/11* (2013.01)

(58) Field of Classification Search
CPC ..... G03G 15/065; G03G 2221/0005; G03G 15/0266; G03G 15/11
USPC ..... 399/240, 245
See application file for complete search history.

(56) References Cited

U.S. PATENT DOCUMENTS

| | | | | |
|---|---|---|---|---|
| 2008/0080883 | A1 | 4/2008 | Takahashi | |
| 2010/0040387 | A1 | 2/2010 | Hirai | |
| 2011/0103814 | A1* | 5/2011 | Toyama et al. | 399/49 |
| 2011/0249990 | A1 | 10/2011 | Izawa et al. | |
| 2011/0274466 | A1 | 11/2011 | Izawa et al. | |
| 2012/0237237 | A1 | 9/2012 | Hirai | |

OTHER PUBLICATIONS

International Search Report (EPO) and Written Opinion (NL) dated Nov. 29, 2013 (10 pages).
European Search Report completed Nov. 27, 2014 (6 pages).

* cited by examiner

*Primary Examiner* — David Bolduc
*Assistant Examiner* — Barnabas Fekete
(74) *Attorney, Agent, or Firm* — Andrew J. Anderson, Esq.; Harter Secrest & Emery LLP

(57) ABSTRACT

A digital printing apparatus comprising a developing roller (102) and an image carrying roller (101); the developing roller (102) being arranged to transfer liquid toner (107) onto the image carrying roller (101) in accordance with a charge pattern; an upstream charger (111) upstream of an area (108) of rotational contact between the developing roller (102) and the image carrying roller (101); a downstream discharger (112, 122, 132) downstream of the area (108); a sensor (200) downstream of the area (108) to detect a property representative of the charge of a liquid toner residue; and a controller (210) to receive sensor data from the sensor (200) and to provide a control signal to control the downstream discharger.

21 Claims, 5 Drawing Sheets

DIGITAL PRINTING SYSTEM WITH IMPROVED TONER REMOVAL

FIELD OF THE INVENTION

The present invention pertains to the field of digital printing apparatus, in particular systems using liquid toner, and more particularly to a digital printing apparatus of a type comprising a developing roller and an image carrying roller in which the developing roller is arranged to transfer a portion of a quantity of liquid toner onto the image carrying roller in accordance with a charge pattern sustained on a surface of the image carrying roller.

BACKGROUND OF THE INVENTION

Digital printing apparatus using liquid toner are known from US Patent Application Publication No. 2011/0249990. The known digital printing apparatus comprises a feed roller, a developing roller, developing roller cleaning means, and an image carrying roller; the feed roller being arranged to transfer a quantity of liquid toner from a reservoir onto the developing roller; and the developing roller being arranged to transfer a portion of the quantity of liquid toner onto the image carrying roller in accordance with a charge pattern sustained on a surface of the image carrying roller.

In digital printing systems of this kind, it is necessary to remove the liquid toner residue that remains on the surface of the developing roller after contact with the imaging roller (typically a roller with a photoconductive surface, adapted to carry a latent image formed by a pattern of charges on that surface). The removal of this residue is quite challenging.

European Patent Application Publication No. 2685320 in the name of the Applicant describes the use of an oscillating electric field arranged to substantially decompactify the chargeable imaging particles in a liquid toner residue on a developing roller, prior to or during its mechanical removal.

In the digital printing apparatus according to the aforementioned US Patent Application Publication No. 2011/0249990, an upstream corona charger is arranged opposite to a surface of the developing roller downstream of the area of its rotational contact with the feed roller and upstream of the area of its rotational contact with the image carrying roller, and a downstream corona discharger is arranged opposite to a surface of the developing roller downstream of the area of its rotational contact with the image carrying roller and upstream of the area of its rotational contact with the developing roller cleaning means. The downstream corona discharger applies charges which are of a polarity opposite to that of charges applied by the upstream corona charger to impart a force to toner particles that are flocculated or agglutinated to remain on the surface of the developing roller by the upstream corona charger. It is alleged that the resulting force acts in a direction in which the toner particles come off the surface of the developing roller, and it is claimed that this results in easier removal of the residual toner from the surface of the developing roller.

It has been found, however, that the arrangement of US Patent Application Publication No. 2011/0249990 does not always lead to optimal removal of the residual liquid toner.

SUMMARY OF THE INVENTION

It is a purpose of embodiments of the present invention to provide a digital printing system allowing for improved residual toner removal.

This goal is achieved by a digital printing apparatus in accordance with one or more of the embodiments of this invention. The digital printing apparatus preferably comprises a developing roller and an image carrier roller. An upstream charger is arranged upstream of an area of rotational contact between the developing roller and the image carrying roller. A downstream discharger is arranged downstream of the area of rotational contact. A sensor is arranged downstream of the area of rotational contact and is adapted to detect a property representative of the charge of a liquid toner residue downstream of the area of rotational contact. A controller is arranged to receive sensor data from the sensor and to provide a control signal to control the downstream discharger based on the received sensor data.

The present invention goes against the teaching of prior US Patent Application Publication No. 2011/0249990, in that it does not aim at imparting a fixed inverse charge onto the imaging particles, but rather at controlling the charge of the liquid toner residue. More in particular, the object of embodiments of the invention is to impart a controlled low charge on the imaging particles downstream of the downstream discharger, preferably rendering the imaging particles downstream of the downstream discharger more or less electrically neutral.

Embodiments of the present invention are based inter alia on the inventive insight that two distinct but related effects have to be overcome to efficiently remove the liquid toner from the developing roller: the tendency of the imaging particles to stay close to the surface of the roller (this "compacting" of the toner is in fact deliberately induced to a certain degree at the charging stage), and the tendency of the imaging particles to cling together in large quantities to form gelatinous structures (known as "caking").

Embodiments of the present invention are based inter alia on the surprising discovery by the inventors, that bringing the average charge of the imaging particles back to a small value or to zero yields the highest effectiveness of the developing roller cleaning means. This discovery is surprising because it could be expected that simply taking the liquid toner out of the electric field of the developing roller, e.g. by transferring it to an uncharged cleaning roller, would cause the toner to spontaneously decompact as a result of the mutual repulsion of the electrically charged imaging particles. This turns out not to be the case, presumably because other small-scale mechanical and physico-chemical effects tend to keep the liquid toner in a partially caked form, which resists the decompacting forces.

The sensor is preferably arranged downstream of the discharger such that a closed-loop control system is obtained. According to a less preferred variant of the invention, the sensor is arranged between the downstream discharger and the area of rotational contact between the developing roller and the image carrying roller, such that an open-loop control system is obtained.

The controller is preferably configured to control the downstream discharger such that the residual charge of the liquid toner residue at a location downstream of the discharger is within a predetermined range. This range is preferably chosen in such a way that the tendency of the imaging particles of the liquid toner residue to stay close to the surface and the tendency of the imaging particles to cling together in large quantities are removed. Typically, the controller is configured to minimize the absolute value of this residual charge.

The downstream discharger is preferably configured to produce an electric field in the liquid toner residue, wherein the control signal sent to the discharger pertains to at least one of a DC bias voltage or a DC bias current applied to produce the electric field. More preferably, the downstream discharger is configured to produce an oscillating electric field. The control signal may then pertain to at least one of a DC bias voltage or current, and, and/or a frequency and/or amplitude of an AC voltage or current for producing the oscillating electrical field. For completeness it is noted that "oscillating" may refer to sine waves, square waves, triangular waves, etc.

According to a possible embodiment the discharger is a corona. The developing roller is typically biased at a voltage between 200 V and 600 V. When only a DC bias is applied, the applied voltage on the corona is preferably in a range between −2 kV and −8 kV, more preferably between −3.5 kV and −5 kV. When applying an AC voltage, the AC voltage may have e.g. a DC component in a range between +1 kV and −1.5 kV, preferably between −300 V and −500 V; a frequency in a range between 500 Hz and 5 kHz, preferably between 1 kHz and 2 kHz; and an amplitude in a range between 1 kV and 8 kV, preferably between 3 kV and 5 kV. Alternatively the corona may be biased with a DC and/or AC current. The current may be regulated e.g. in a range between 50 μA and 1 mA. As the charging behavior is less sensitive to current changes compared to voltage changes, adjusting the current instead of the voltage will make controlling the residual charge of the liquid toner easier.

The downstream discharger is typically a corona discharger, but may also be a discharge roller or a discharge blade, or a combination thereof. In case of a discharge roller, the voltage difference to be applied between the developing roller and the discharge roller will be dependent on the thickness of the liquid layer. In case of a discharge blade, the voltage difference to be applied between the developing roller and the discharge blade will be dependent on the thickness of the liquid layer and the thickness of the insulating layer surrounding the electrode included in the blade. A suitable value for the voltage difference would typically be larger than 100 V.

In an embodiment of the digital printing apparatus according to the present invention, the downstream discharger and the sensor are arranged opposite to a surface of the developing roller. Also the upstream charger is typically arranged opposite to a surface of the developing roller.

In a further embodiment, there are provided developing roller cleaning means. The downstream discharger is then preferably located upstream of the area of rotational contact between the developing roller and the developing roller cleaning means. In a particular embodiment, a cleaning roller is arranged in rotational contact with the developing roller. In that case, the downstream discharger and/or the sensor may also be arranged opposite to a surface of the cleaning roller.

The sensor may e.g. be an electrostatic voltage sensor or an optical density sensor. If an optical density sensor is used, the sensor is preferably located downstream of the liquid toner residue cleaning means. In that way, the density will be a measure for the cleaning performance, and thus also a measure for the discharging performance. In other words, the optical density is also a property which is representative for the charge of the liquid toner.

In an embodiment of the digital printing apparatus according to the present invention, the upstream charger applies positive charges to the surface of the developing roller, and the downstream discharger applies negative charges to the surface of the developing roller.

BRIEF DESCRIPTION OF THE SEVERAL VIEWS OF THE DRAWINGS

These and other features and advantages of embodiments of the invention will now be described in relation to the attached drawings.

DETAILED DESCRIPTION OF THE INVENTION

Figure 1:
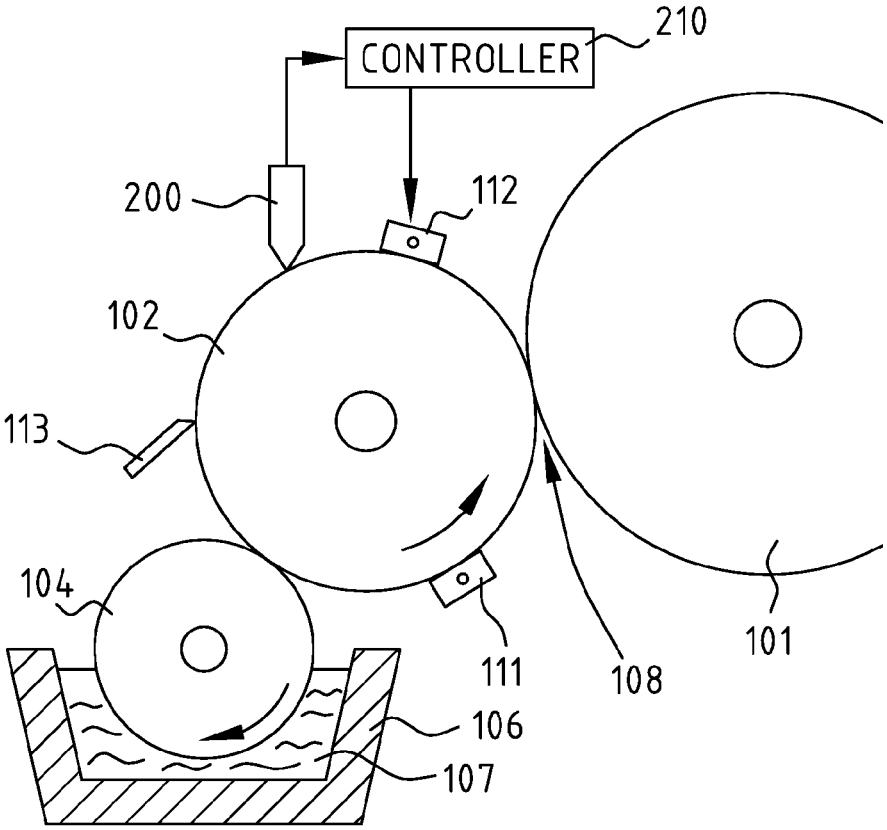
FIG. 1 schematically illustrates a digital printing apparatus according to a first embodiment.

Generally, a digital printing apparatus comprises a feed roller 104, a developing roller 102, and an image carrying roller 101. The feed roller 104 is arranged to transfer a quantity of liquid toner 107 from a reservoir 106 onto the developing roller 102; and the developing roller 102 is arranged to transfer a portion of the quantity of liquid toner 107 onto the image carrying roller 101 in accordance with a charge pattern sustained on a surface of the image carrying roller 101. Reference is made to the aforementioned citations for further details about the operation of digital printing apparatus of this kind.

A first embodiment of a digital printing apparatus of the invention is illustrated in FIG. 1. In this embodiment an upstream corona charger 111 is arranged opposite to a surface of the developing roller 102 downstream of the area of its rotational contact with the feed roller 104 and upstream of the area 108 of its rotational contact with the image carrying roller 101. Also, a downstream corona discharger 112 is arranged downstream of the area 108 of rotational contact between the developing roller 102 and the image carrying roller 101 and upstream of the area of rotational contact between the developing roller 102 and a developing roller cleaning means, here in the form of a scraper 113. In a typical arrangement, the upstream corona charger 111 applies positive charges to the surface of the developing roller 102, and the downstream corona discharger 112 applies negative charges to the surface of the developing roller 102.

A sensor 200 is arranged downstream of the downstream corona discharger 112, and is adapted to detect a residual charge of a liquid toner residue, i.e. the toner that remains on the developing roller 102 after its contact with the image carrying roller 101. An example of a suitable sensor is an electrostatic voltage sensor.

The digital printing apparatus further comprises a controller 210 arranged to receive sensor data from the sensor 200 and to provide a control signal to control the downstream corona discharger 112. The controller 210 is configured to control the corona discharger such that the residual charge of the liquid toner residue is within a predetermined range.

According to a possible embodiment, the controller is configured to minimize the absolute value of the residual charge. In other words, the controller 210 calculates the operational parameters for the downstream corona discharger 112 that are expected to minimize the difference between a measured value for the charge and a target value. In particular, the target value may be the sensor value that corresponds, after calibration, to electric neutrality at the level of the toner particles.

The developing roller 102 is typically biased at a voltage between 200 V and 600 V. The downstream corona discharger 112 may produce either a DC electric field or an AC electric field. If a DC electric field is applied, the applied DC voltage is typically in a range between −2 kV and −8 kV, preferably between −3.5 kV and −5 kV. If the downstream corona discharger 112 is configured for producing an AC electric field, the following values may be used:

- a DC voltage of +1 kV to −1.5 kV typically between −300 V and −500 V;
- an AC rms voltage between 1 kV and 8 kV, typically between 3 kV and 5 kV;
- a frequency between 500 Hz and 5 kHz, typically between 1 kHz and 2 kHz.

The applied DC voltage on the corona charger 111 is typically in a range between 2 kV and 8 kV, preferably between 3.5 kV and 5 kV.

Alternatively the corona charger 111 and/or discharger 112 may be biased with a DC and/or AC current may. The DC current of the corona discharger 112 may be regulated e.g. in a range between 50 μA and 1 mA. As the charging behavior is less sensitive to current changes compared to voltage changes, adjusting the current instead of the voltage will make controlling the residual charge of the liquid toner easier.

Suitable values for the DC and/or AC voltage or current applied on the downstream corona discharger 112 will typically depend on a large number of parameters such as the process speed, the toner parameters, the device geometry, the initial toner charge voltage, etc.

Typically a number of alternations of the oscillating electric field will be necessary for obtaining an appropriate decompacting of the liquid toner residue. The number of alternations that the liquid toner residue is subjected to when passing the downstream corona discharger is dependent on the process speed and the AC frequency of the AC signal. This is illustrated in the table below for a 15 mm corona.

Number of alternations for given process speed and AC frequency (corona 15 mm)

| | 1 m/s | 2 m/s | 3 m/s |
|---|---|---|---|
| 500 Hz | 7.5 | 3.25 | 2.5 |
| 1 kHz | 15 | 7.5 | 5 |
| 2 kHz | 30 | 15 | 10 |

Depending on the toner parameters, for a process speed of 1 m/s, e.g. 15 alternations may be sufficient, in which case a frequency of 1 kHz could be used. In other words, for a fixed process speed, the number of alternations applied on an imaging particle passing the corona discharger may be varied by varying the AC frequency. In that way the decompacting of the liquid toner residue can be controlled in an improved way.

In the variant of FIG. 1, the downstream corona discharger 112 and the sensor 200 are arranged opposite to a surface of the developing roller 102.

Figure 2:
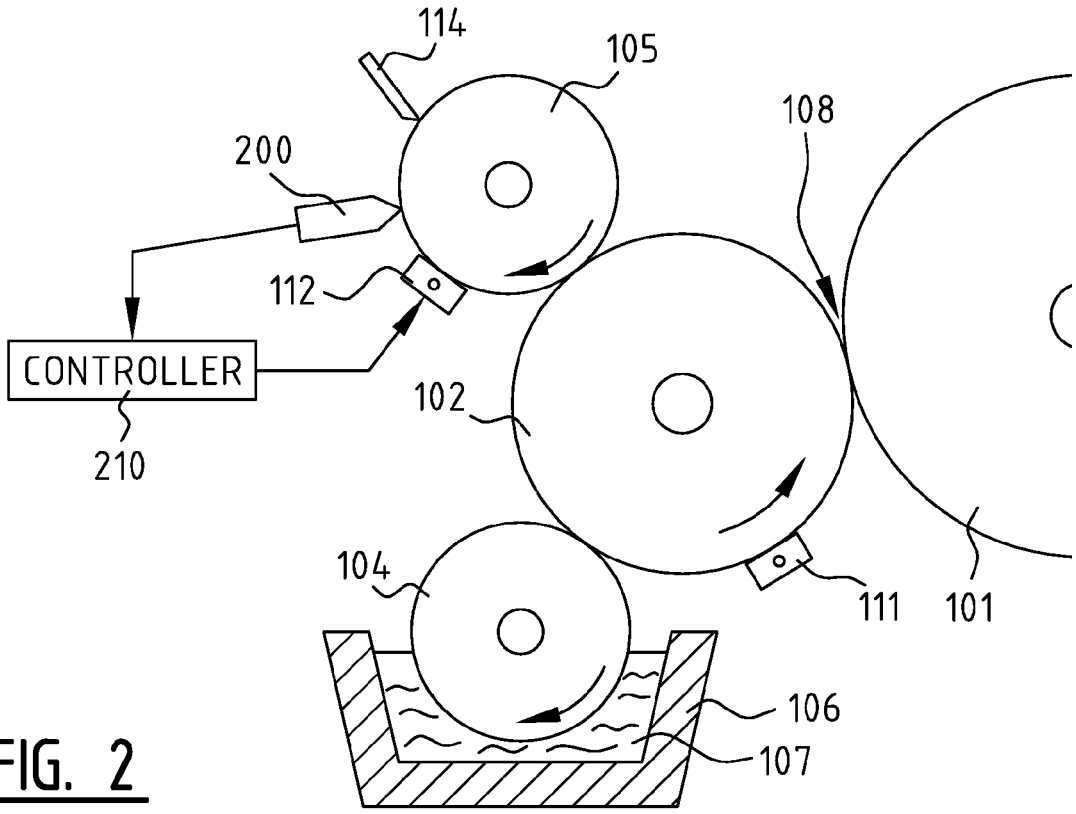
FIG. 2 schematically illustrates a digital printing apparatus according to a second embodiment including a cleaning roller.

In the embodiment of FIG. 2, the developing roller cleaning means comprises a cleaning roller 105 arranged in rotational contact with the developing roller 102, and a scraper 114. The downstream corona discharger 112 and the sensor 200 are arranged opposite to a surface of the cleaning roller 105. According to a non-illustrated variant of the embodiment of FIG. 2, the sensor 200 and corona discharger 112 could be arranged opposite to a surface of the developing roller 102, or the sensor could be arranged opposite to a surface of the cleaning roller 105, while the corona discharger 112 is arranged opposite to a surface of the developing roller 102.

Figure 3:
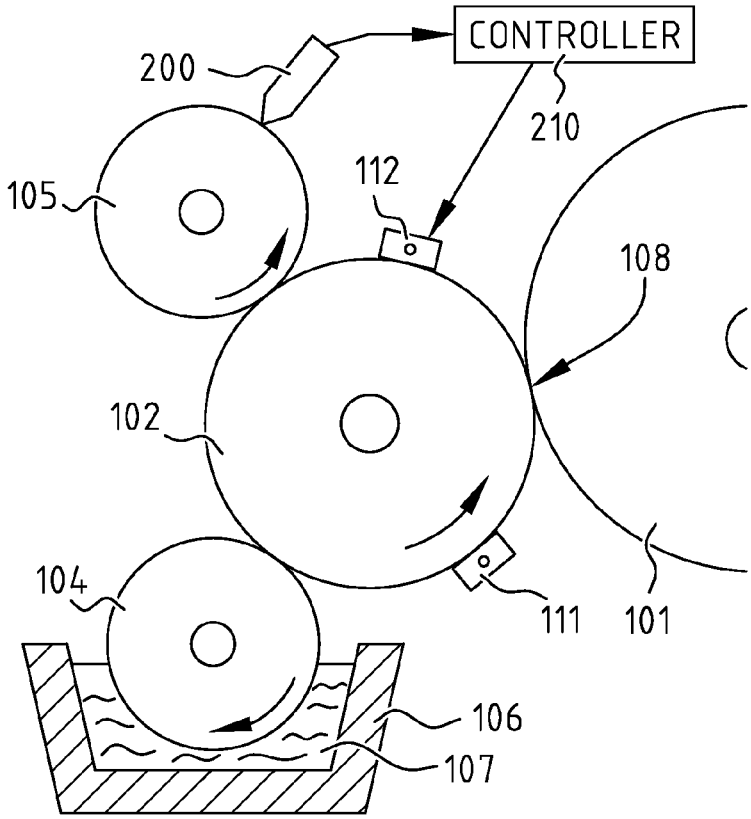
FIG. 3 schematically illustrates a digital printing apparatus according to a third embodiment including a squeegee roller.

According to a third variant illustrated in FIG. 3, the cleaning roller 105 could be a squeegee roller. In the illustrated example the sensor 200 is located opposite to the cleaning roller 105, while the downstream corona discharger 112 is located opposite to the developing roller 102. The skilled person understands that according to a variant, both the sensor 200 and the corona discharger 112 could be located opposite to the squeegee roller 105, or alternatively opposite to the developing roller 102.

Figure 4:
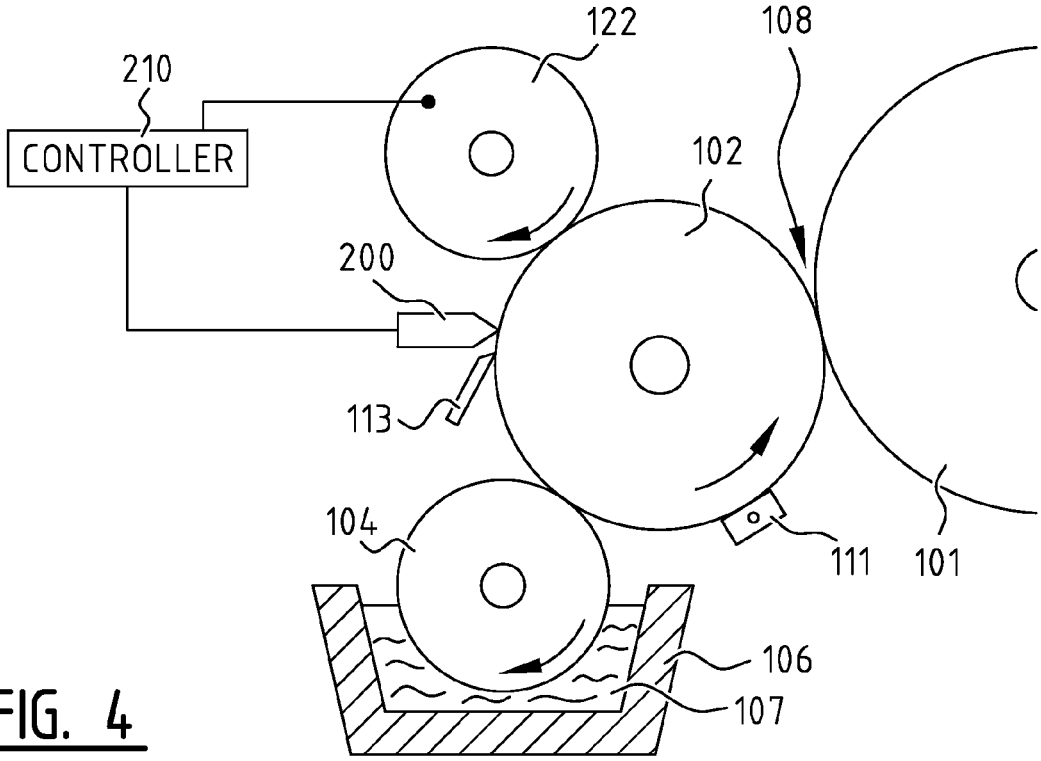
FIG. 4 schematically illustrates a digital printing apparatus according to a fourth embodiment including a discharge roller.

A fourth variant is illustrated in FIG. 4. In this embodiment, the corona discharger 112 is replaced with a discharge roller 122. According to yet another non-illustrated embodiment, the corona discharger 112 could be combined with a discharge roller 122.

Figure 5:
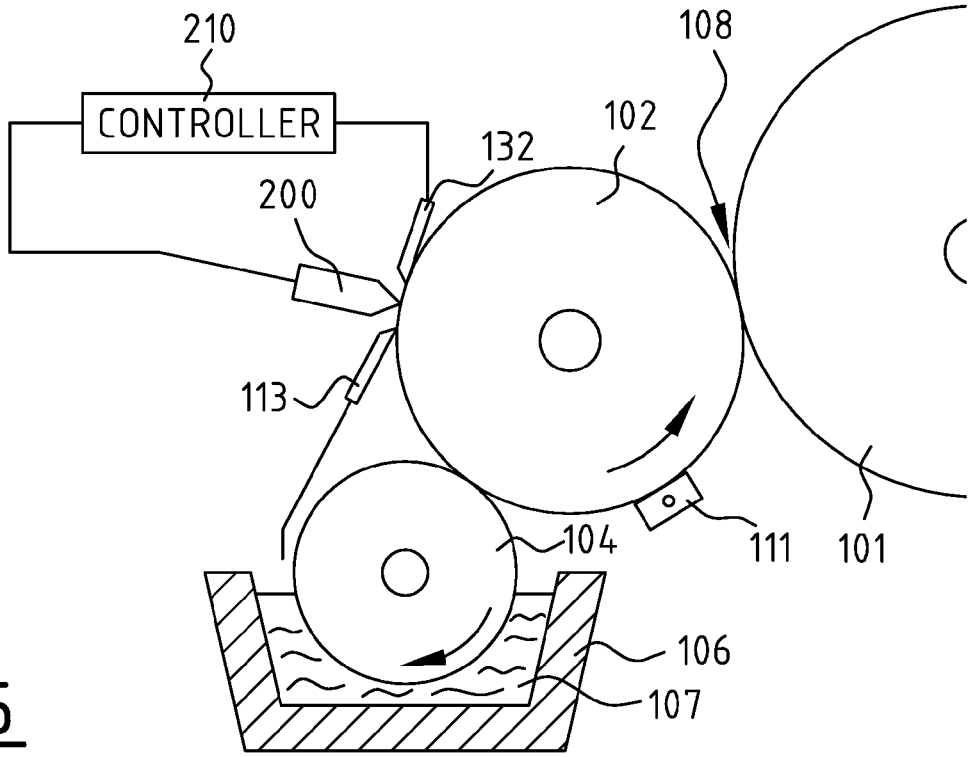
FIG. 5 schematically illustrates a digital printing apparatus according to a fifth embodiment including a discharge blade.

A fifth variant of the invention is illustrated in FIG. 5. In this embodiment, the corona discharger is replaced with a discharge blade 132. Again, the skilled person understands that this discharge blade 132 could be combined with a corona discharger 112 and/or discharge roller 122.

Figure 6:
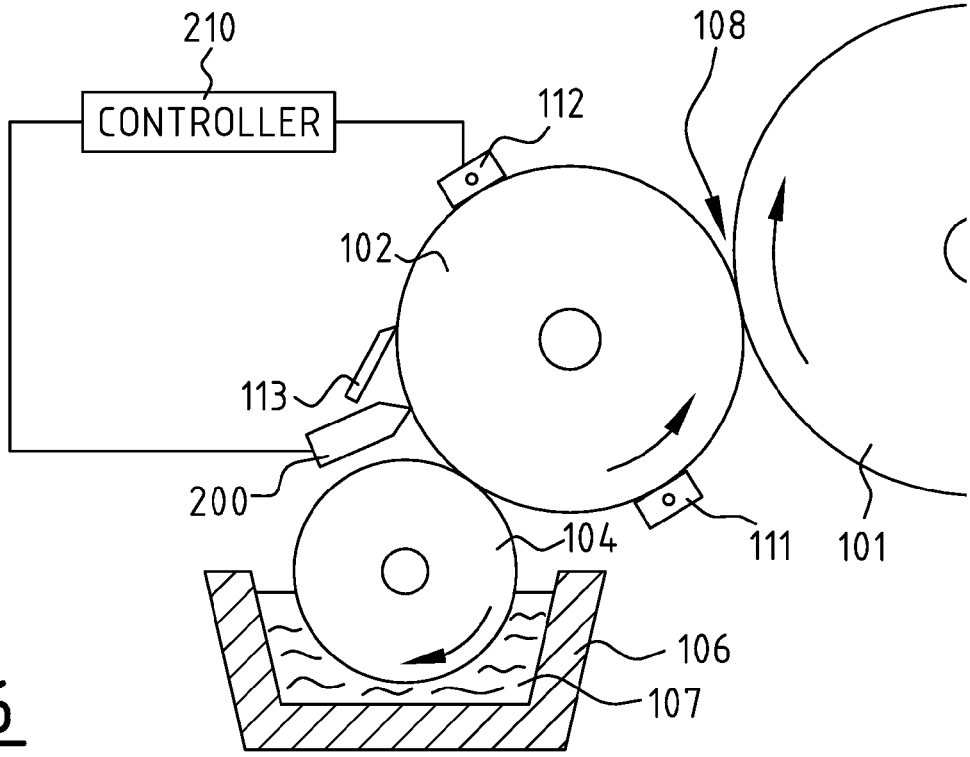
FIG. 6 schematically illustrates a digital printing apparatus according to a sixth embodiment.
Figure 10:
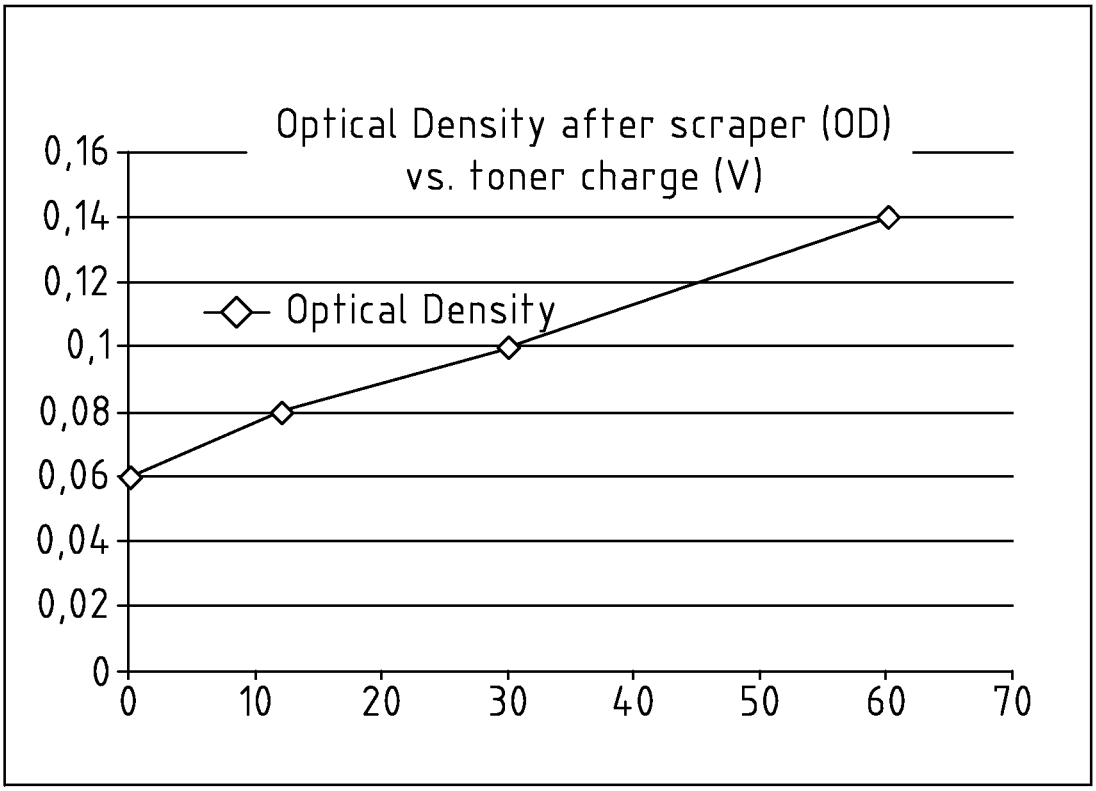
FIG. 10 illustrates a graph of the optical density measured downstream of a scraper, in function of the toner charge.

FIG. 6 illustrates a sixth variant which is similar to the variant of FIG. 1, with this difference that the sensor has been placed downstream of the scraper 113. In this embodiment, the sensor may be an optical density sensor. Indeed, the density of the liquid toner remaining on the developing roller 102 after having passed the scraper 113 is a measure for the cleaning performance of the scraper 113. In turn, the cleaning performance is a measure for the discharge performance and hence a measure for the charge of the liquid toner remaining on the developing roller downstream of the corona discharger 112. The graph of FIG. 10 illustrates the relationship between the optical density and the toner charge. From this graph it can be derived that the optical density is a property of the liquid toner which is representative for the toner charge.

Considering the variant of FIG. 6, the skilled person understands that also for the embodiments of FIGS. 1, 2, 4 and 5, the sensor 200 could be an optical density sensor and could be placed after the scraper 113 for the embodiments of FIGS. 1, 4 and 5, or after the scraper 114 for the embodiment of FIG. 2.

Figure 7:
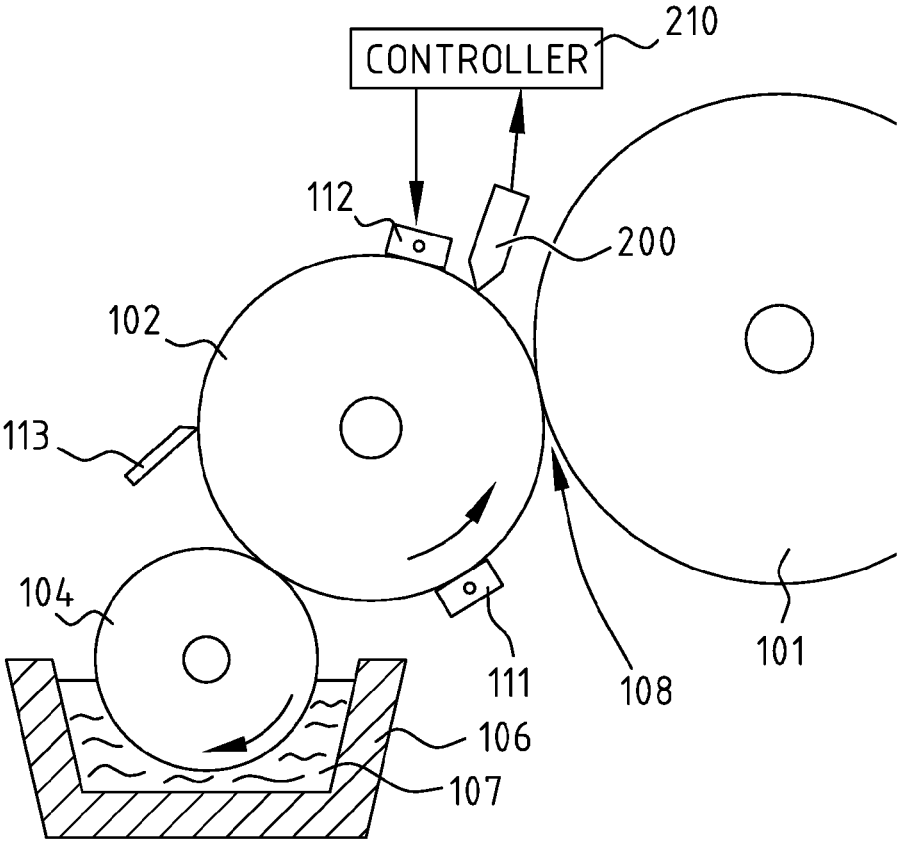
FIG. 7 schematically illustrates a digital printing apparatus according to a seventh embodiment implemented using an open loop control system.

FIG. 7 illustrates a seventh variant implementing an open-loop system instead of a closed-loop system. In this embodiment, the sensor 200 is placed upstream of the corona discharger 112.

Figure 8:
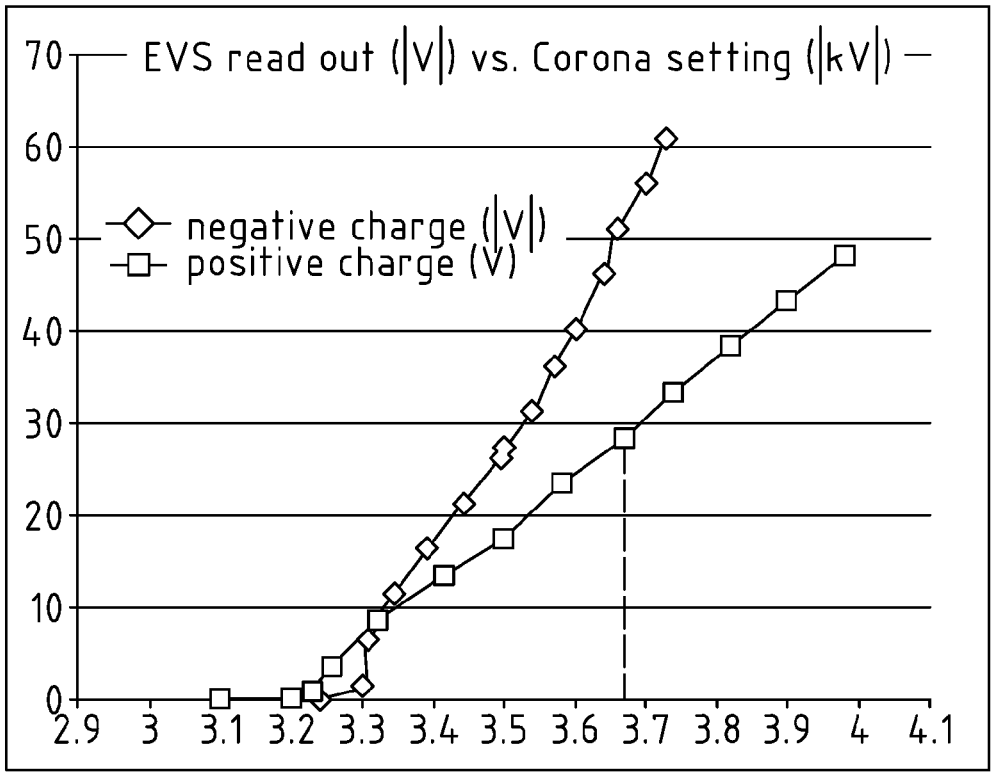
FIG. 8 is a graph illustrating the charging with a negative corona discharger compared to the charging with a positive corona charger in function of the applied bias voltage.

Embodiments of the invention are based on the insight of the inventors that charging and discharging behavior is not identical. This is illustrated in the graph of FIG. 8, which shows the absolute value of the positive and negative charge versus the absolute value of the applied positive and negative bias voltage on the corona charger and discharger, respectively, for a test configuration with a first member biased at 0 V. As shown in FIG. 8, for the toner under test, the negative charge raises faster with the applied DC bias compared to the positive charge. In view of the sharp raising edge of the negative charge with the applied corona voltage, controlling that voltage becomes critical. The skilled person understands that the graph of FIG. 8 is merely an example for a particular type of toner, and that the curves may be substantially different for other liquid toners and/or coronas. For example, for certain other toners, the charging curve could rise faster than the discharging curve. Further, the behavior of the charging and discharging will be dependent on the process speed, the toner parameters, the geometry, the charge pattern on the image carrying roller, etc.

Taking into account the considerations above, the proposed closed-loop of embodiments of the invention may significantly improve the operation of the display apparatus. Although an open-loop system as illustrated in FIG. 7 is an improvement over the prior art, the closed-loop system illustrated in FIGS. 1-6 leads to an even more significant improvement.

Because the discharging curve in the graph of FIG. 8 is more edgy than the charging curve, even a true AC corona discharger (with a zero bias voltage) may discharge the positive potential on the liquid toner residue and may even create a further negative charge when the AC RMS value is sufficiently large.

Figure 9:
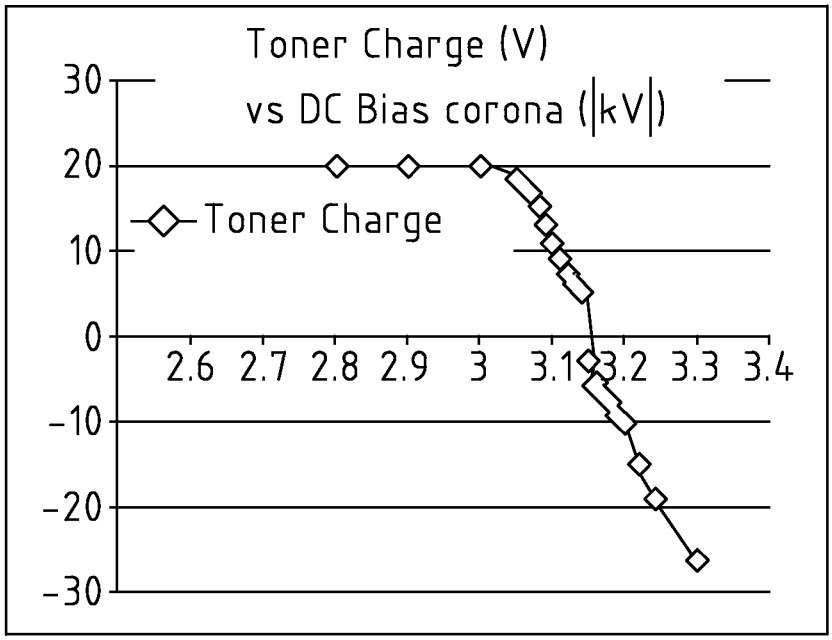
FIG. 9 is a graph illustrating the evolution of the toner charge in function of an applied DC bias on the corona discharger.

FIG. 9 illustrates the charge voltage of a liquid toner residue in function of a DC bias voltage of the corona discharger. Starting off with a 20 V charge level, the graph shows a very steep slope for discharging. Tests have been done on two different test fixtures using both fresh toner and seriously abused toner. Those tests show the same slope and discharge values. This graph further illustrates that a control of the downstream discharger 112, 122, 132 in the embodiments discussed above will significantly improve the operation of the display apparatus.

While the invention has been described hereinabove with reference to embodiments using positively charged toner particles and electric tensions or fields arranged to act on these positively charged toner particles, in particular to electrophoretically move them, a skilled person will immediately appreciate that the invention equally applies to embodiments using negatively charged toner particles. In the latter case, the polarity of the electric fields acting on the toner particles needs to be reversed, leading to a physically equivalent arrangement with the same technical effects. All voltage ranges mentioned in the present description with respect to embodiments operating with positively charged toner particles are hereby stated to also apply to corresponding embodiments operating with negatively charged toner particles, provided that the sign of the voltage values is changed.

Although the invention has been described hereinabove with reference to specific embodiments, this has been done to illustrate and not to limit the invention, the scope of which is to be determined on the basis of the appended claims.

The invention claimed is:

1. A digital printing apparatus comprising:

a developing roller and an image carrying roller, the developing roller being arranged to transfer a portion of a quantity of liquid toner onto the image carrying roller in accordance with a charge pattern sustained on a surface of the image carrying roller;

an upstream charger arranged upstream of an area of rotational contact between the developing roller and the image carrying roller;

a downstream discharger arranged downstream of the area of rotational contact, wherein said downstream discharger is arranged opposite to a surface of the developing roller;

a sensor arranged downstream of the area of rotational contact, the sensor being adapted to detect a property representative of the charge of a liquid toner residue downstream of the area of rotational contact; and a controller arranged to receive sensor data from the sensor and to provide a control signal to control the downstream discharger based on the received sensor data.

2. The digital printing apparatus according to claim 1, wherein the sensor is arranged downstream of the downstream discharger.

3. The digital printing apparatus according to claim 1, wherein the controller is configured to control the downstream discharger such that a residual charge of the liquid toner residue at a location downstream of the downstream discharger is within a predetermined range.

4. The digital printing apparatus according to claim 3, wherein the controller is configured to minimize the absolute value of the residual charge.

5. The digital printing apparatus according to claim 1, wherein the downstream discharger is configured to produce an electric field in the liquid toner residue, and wherein the control signal pertains to at least one of a DC bias voltage or a DC bias current applied to produce the electric field.

6. The digital printing apparatus according to claim 5, wherein the discharger is a corona; wherein the absolute value of a voltage difference between the discharging corona and the developing roller is in a range between 2 kV and 8 kV.

7. The digital printing apparatus according to claim 1, wherein the downstream discharger is configured to produce an AC electrical field, and wherein the control signal pertains to at least one of a DC bias voltage or current, a frequency, and an amplitude of an AC voltage or current for producing the AC electrical field.

8. The digital printing apparatus according to claim 7, wherein the discharger is a corona; wherein the frequency is in a range between 500 Hz and 5 kHz, preferably between 1 kHz and 2 kHz; and/or the amplitude is in a range between 1 kV and 8 kV.

9. The digital printing apparatus according to claim 1, wherein the downstream discharger includes at least one of a corona discharger, a discharge roller, and a discharge blade.

10. The digital printing apparatus according to claim 1, further comprising a feed roller, the feed roller being arranged to transfer a quantity of liquid toner from a reservoir onto the developing roller; wherein the upstream charger is located downstream of the area of rotational contact between the developing roller and the feed roller.

11. The digital printing apparatus according to claim 1, further comprising a developing roller cleaning means; wherein the downstream discharger is located upstream of the area of rotational contact between the developing roller and the developing roller cleaning means.

12. The digital printing apparatus according to claim 1, wherein the sensor is arranged opposite to a surface of the developing roller; and/or wherein the upstream charger is arranged opposite to a surface of the developing roller.

13. The digital printing apparatus according to claim 1, wherein the sensor is an electrostatic voltage sensor or an optical density sensor.

14. The digital printing apparatus according to claim 1, comprising a liquid toner residue cleaning means wherein the sensor is an optical density sensor which is arranged downstream of the liquid toner residue cleaning means.

15. The digital printing apparatus according to claim 1, wherein the upstream charger applies positive charges to the surface of the developing roller, and wherein the downstream discharger applies negative charges to the surface of the developing roller.

16. The digital printing apparatus according to claim 1, wherein a cleaning roller is arranged in rotational contact with the developing roller, and wherein the sensor is arranged opposite to a surface of the cleaning roller.

17. A digital printing apparatus comprising:

a developing roller and an image carrying roller, the developing roller being arranged to transfer a portion of a quantity of liquid toner onto the image carrying roller in accordance with a charge pattern sustained on a surface of the image carrying roller;

an upstream charger arranged upstream of an area of rotational contact between the developing roller and the image carrying roller;

a downstream discharger arranged downstream of the area of rotational contact:

a sensor arranged downstream of the area of rotational contact, the sensor being adapted to detect a property representative of the charge of a liquid toner residue downstream of the area of rotational contact; and a controller arranged to receive sensor data from the sensor and to provide a control signal to control the downstream discharger based on the received sensor data;

wherein a cleaning roller is arranged in rotational contact with the developing roller, and wherein the downstream discharger is arranged opposite to a surface of the cleaning roller.

18. The digital printing apparatus according to claim 17, wherein the sensor is arranged downstream of the downstream discharger.

19. The digital printing apparatus according to claim 18, wherein the controller is configured to control the discharger such that a residual charge of the liquid toner residue at a location downstream of the discharger is within a predetermined range.

20. The digital printing apparatus according to claim 17, wherein the upstream charger is arranged opposite to a surface of the developing roller.

21. The digital printing apparatus according to claim 17, wherein the sensor is arranged opposite to a surface of the cleaning roller.

* * * * *